US009315250B1

(12) United States Patent
Huyer et al.

(10) Patent No.: US 9,315,250 B1
(45) Date of Patent: Apr. 19, 2016

(54) SYSTEMS AND METHODS TO GENERATE POST-SWIRL PROPULSOR SIDE FORCES

(75) Inventors: Stephen A. Huyer, Saunderstown, RI (US); David N. Beal, Providence, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 619 days.

(21) Appl. No.: 13/609,753

(22) Filed: Sep. 11, 2012

(51) Int. Cl.
*B63H 5/04* (2006.01)

(52) U.S. Cl.
CPC ..... *B63H 5/04* (2013.01)

(58) Field of Classification Search
CPC ..... F42B 19/01; F42B 10/64; F42B 19/06; B63H 11/117
See application file for complete search history.

(56) References Cited

U.S. PATENT DOCUMENTS

| | | | | | |
|---|---|---|---|---|---|
| 702,729 | A | * | 6/1902 | Holland | 114/333 |
| 4,648,322 | A | * | 3/1987 | Heitz et al. | 102/411 |
| 4,919,066 | A | * | 4/1990 | Gongwer | 114/338 |

OTHER PUBLICATIONS

Stephen A. Huyer, Postswirl Maneuvering Propulsor, paper, Apr. 2015, 041104-1-041104-10, vol. 137, Journal of Fluids Engineering,USA.

* cited by examiner

*Primary Examiner* — Edwin Swinehart
(74) *Attorney, Agent, or Firm* — James M. Kasischke; Michael P. Stanley

(57) ABSTRACT

Systems and methods for maneuvering an underwater vehicle by generating vehicle maneuvering forces from a propulsor of the vehicle are provided. A post-swirl propulsor is configured such that pitch angles of downstream stator blades can be individually varied. The variation in pitch results in the generation of multiple forces and moments for vehicle control.

1 Claim, 2 Drawing Sheets

SYSTEMS AND METHODS TO GENERATE POST-SWIRL PROPULSOR SIDE FORCES

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

This application is related to co-pending U.S. patent application Ser. No. 12/651,559 filed on Jan. 4, 2010 and entitled "SYSTEMS AND METHODS TO GENERATE PROPULSOR SIDE FORCES", this application being by the same inventors as the co-pending application.

BACKGROUND OF THE INVENTION (1) Field of the Invention

The present invention relates to maneuvering an underwater vehicle, and more specifically to systems and methods for generating vehicle maneuvering forces from a post-swirl propulsor.

(2) Description of the Prior Art

Standard torpedoes and Unmanned Undersea Vehicles (UUVs) utilize a single propulsor at the stern in combination with control surfaces to provide the vehicle with necessary forces and moments to produce control of the vehicle. At higher speeds, this combination is generally satisfactory in terms of offering sufficient control. At low speeds, control surface effectiveness is significantly diminished, with the extreme condition being zero forward velocity (e.g., Bollard condition). There are several operations where low speed control is vitally important for UUV mission requirements. These include UUV recovery, station keeping and synthetic aperture sonar.

In the art, side forces have been generated using thrust vectoring. In thrust vectoring, the thrust is re-directed off axis to generate side forces for control. To meet low speed requirements, autonomous research vehicles have utilized tunnel thrusters to offer lateral and vertical control.

The difficulty is that thrust vectoring is most effective for zero speeds. As the flow velocity is increased, tunnel thruster effectiveness is significantly diminished. For example, it has been shown that tunnel thrusters are only 20% effective above five knots. The tunnel thrusters also increase drag such that maximum velocities are reduced. In addition, tunnel thrusters use considerable volume that could otherwise be used for energy or payload.

Another prior art design is referred to as the Haselton bow propulsor. In this concept, a pair of propellers, one at the bow and one at the stern, is used in tandem to provide vehicle control. Side forces are generated via cyclic pitch actuation similar to that used for helicopter rotors.

The Haselton design utilizes a swashplate so that angle of attack is varied over a single propeller rotation. For example, if maximum and minimum angles of attack are reached at 0° and 180°; the higher thrust force at 0° and lower thrust force at 180° will generate a moment couple. By adding rake and skew to the propeller, it is then possible to generate a substantial side force component.

A disadvantage is that the Haselton bow propulsor concept remains mechanically complex for implementation on undersea vehicles. In addition, placing a propulsor at the bow of the vehicle interferes with the forward looking sonar that is used on most UUVs and torpedoes.

In previous research, a pre-swirl propulsor capable of generating side forces of sufficient magnitude to provide vehicle control and maneuvering was investigated. It was found that varying the pitch angles of the upstream stator blades of a ducted, pre-swirl propulsor can both generate a mean stator side force and subsequently vary the axial velocity and swirl that is ingested into the inflow. The rotor can then generate a side force in response to the inflow.

The research also showed that the stator row generated significantly larger forces compared with the rotor. The rotor generates side forces in response to the stator modified inflow. For baseline rotor designs, the side forces are in a direction opposite to the stator forces (i.e., the rotor effectively attenuates the stator side forces).

Additionally, it was found that open propulsors (i.e., propulsors without a shroud) generated side forces in a manner as to be more efficient than standard vehicle control surfaces. By sinusoidally varying the stator blade pitch distribution about the circumference, it is possible to generate significant side forces.

However, ducted pre-swirl propulsor configurations (i.e., propulsors with a shroud) generated side forces with magnitudes approximately three times smaller than open configurations. The shroud produces opposing forces resulting in the diminishment of the overall side forces. For this reason, open pre-swirl propulsor configurations were proposed for further examination to offer an alternative for vehicle control.

There are several undersea vehicle applications where a ducted propulsor configuration is desirable. This includes pumpjet and rim-driven electric motor configurations. For these cases, a post-swirl propulsor is utilized with an upstream rotor blade row and a downstream stator blade row. For normal post-swirl designs, propulsive efficiency can be improved with effective stator blade row design. The rotor swirls the flow ingested into the stator. The stator can be designed to remove the swirl and at the same time generate roll moment to counter the rotor roll moment.

What are therefore needed are systems and methods for maneuvering an underwater vehicle having a ducted post-swirl propulsor. The systems and methods should be effective at reasonable operating speeds; should not significantly reduce maximum velocities; and should not take up considerable volume. Additionally, the systems and methods should be relatively simple to implement without interfering with forward looking sonar.

SUMMARY OF THE INVENTION

It is therefore a general purpose and primary object of the present invention to provide systems and methods for maneuvering an underwater vehicle by generating vehicle maneuvering forces from a propulsor of the vehicle.

This object is attained by the present invention by configuring a post-swirl propulsor such that the pitch angles of the downstream stator blades can be individually varied. The variation in pitch results in the generation of multiple forces and moments to allow for vehicle control.

In one embodiment, a post-swirl propulsor system for an underwater vehicle includes a rotor and a row of stator blades downstream of the rotor. A pitch angle of the stator blades varies about a circumference of the vehicle. A thrust flow from the rotor combines with a circumferentially varying flow from the stator blades to produce a force on the vehicle that is perpendicular to a main axis of the vehicle.

The pitch angle is adjustable and the pitch angle of each stator blade can be adjusted. The system can include a controller to determine the pitch angle for each stator blade. A servo-motor is connected to each stator blade. The pitch angle of the stator blade connected to the servo-motor is adjustable by actuation of the servo-motor by the controller.

In one embodiment, a system for maneuvering an underwater vehicle includes a rotor and a plurality of stator blades downstream of the rotor. The stator blades form a row about the circumference of the vehicle and the pitch angle of the stator blades is adjustable.

The system includes a plurality of servo-motors, with each servo-motor connected to one or more of the stator blades. When actuated, the servo-motor adjusts the pitch angle of the one or more stator blades connected thereto.

A controller is connected to the servo-motors and coordinates the actuation of the servo-motors to vary the pitch angles of the stator blades about the circumference. The varying pitch produces a circumferentially varying flow from the stator blades which produces a force on the vehicle perpendicular to a main axis of the vehicle. Additionally, the system can include a shroud about the rotor and the shroud may extend about the stator blades.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE INVENTION

Figure 1:
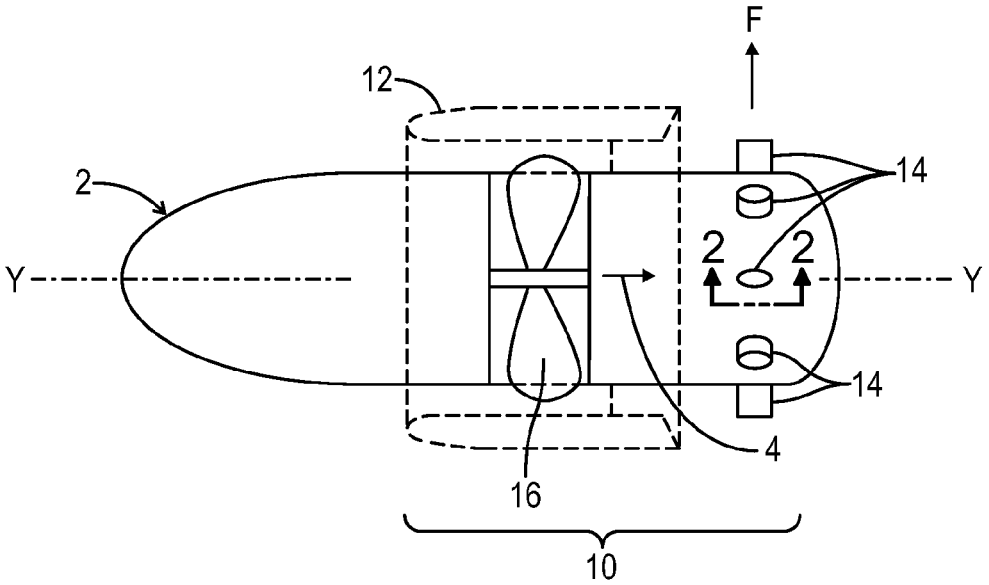
FIG. 1 shows a side view of a ducted post-swirl propulsor.

Referring to FIG. 1, there is shown a schematic side view of an underwater vehicle 2 having a ducted post-swirl propulsor 10. For clarity of illustration in FIG. 1, a duct or shroud 12 of the propulsor 10 is shown in phantom. Stator blades 14 are situated downstream of a rotor 16.

During normal operation, the downstream stator blades 14 are each situated at the same pitch angle, or angle of attack. The flow coming off the rotor 16 (illustrated by arrow 4) is swirled by the stator blades 14. As is known to those of skill in the art, post-swirling the flow results in generating a roll moment which counters the moment produced by the rotor 16.

Figure 2:
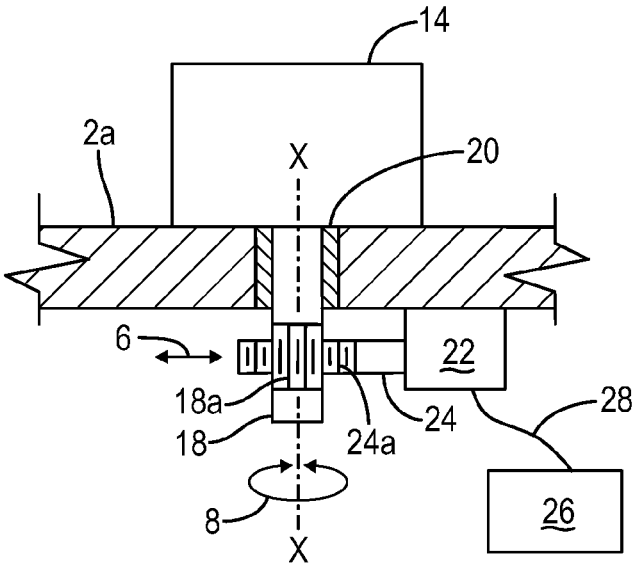
FIG. 2 shows cross-sectional view of a stator blade of the propulsor taken in regard to reference lines A-A of FIG. 1.

Referring now to FIG. 2, there is shown a cross-sectional side view of an exemplary stator blade 14, taken at line A-A of FIG. 1. The stator blade 14 is connected to a shaft 18. As shown in FIG. 2, the stator blade 14 is positioned exterior to a hull 2*a* of the vehicle 2. The shaft 18 penetrates through the hull 2*a* and extends interior to the hull. A seal 20 surrounds the shaft 18 to provide a waterproof seal for the shaft.

Activation of a servo-motor 22 results in the extension or retraction of an actuator arm 24 as indicated by arrow 6. The actuator arm 24 engages the shaft 18 to turn the shaft about its axis X-X, as indicated schematically by arrow 8. Rotation of the shaft 24 results in varying the pitch angle of the stator blade 14. For illustration, but not limitation, teeth 24*a* on actuator arm 24 are depicted as engaging teeth 18*a* on the shaft 18.

For the propulsor 10 to generate vehicle maneuvering forces, downstream stator blades 14 are situated at varying pitch angles using the servo-motors 22. Experiments with pre-swirl propulsors indicate that this variation in pitch angles results in the downstream stator blades 14 generating a stator side force (as illustrated by arrow F in FIG. 1) perpendicular to axis Y-Y of vehicle 2. A controller 26 (illustrated within the hull 2*a* in FIG. 2) connects to each servo-motor 22 (illustrated by line 28 in FIG. 2) and coordinates the actions of the servo-motors to obtain the desired maneuvering forces.

What has thus been described is a propulsor system that generates side forces utilizing a post-swirl propulsor configuration with the downstream stator blades situated at varying pitch angles to generate a circumferentially varying flow. This variation in stator blade pitch also results in side force generation by the stator blade row.

Figure 3:
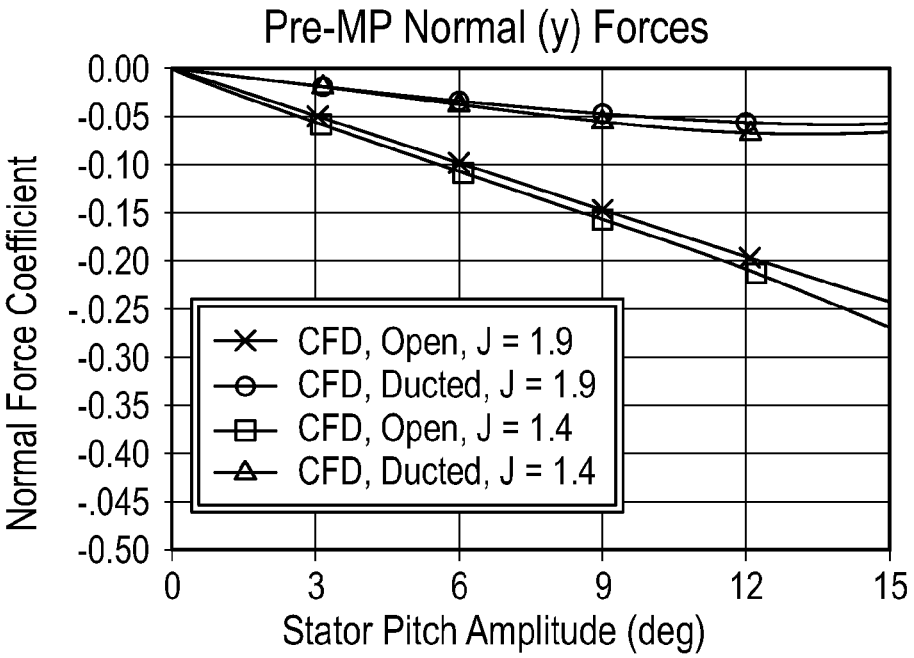
FIG. 3 depicts forces produced by a pre-swirl maneuvering propulsor.
Figure 4:
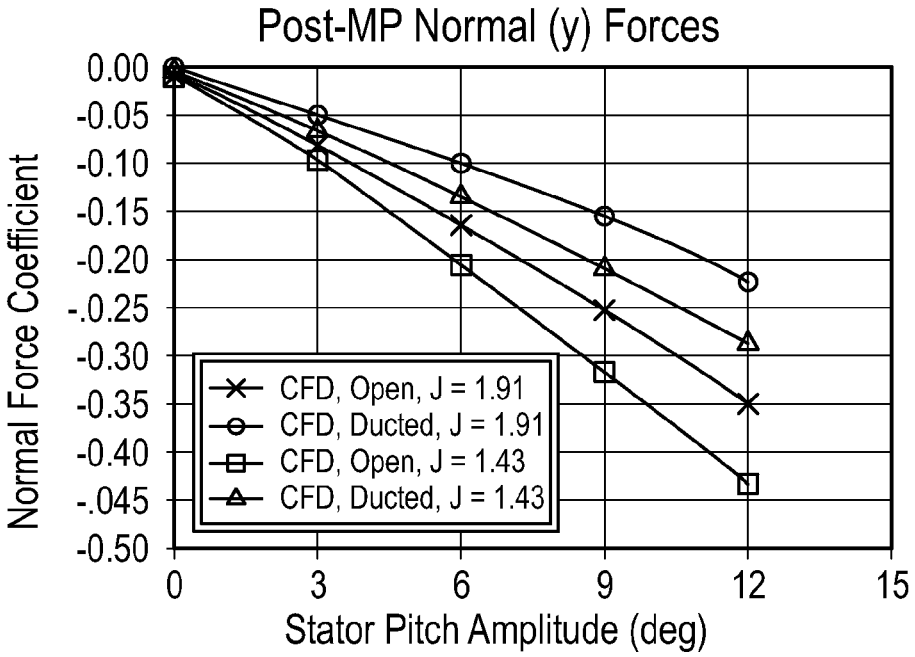
FIG. 4 depicts forces produced by a post-swirl maneuvering propulsor.

FIG. 3 and FIG. 4 depict a comparison between the forces produced by a pre-swirl maneuvering propulsor (FIG. 3) and a post-swirl maneuvering propulsor (FIG. 4). Various Computational Fluid Dynamics (CFD) are depicted.

The pre-swirl results of FIG. 3 are a combined experimental and numerical evaluation. Two advance ratios ($J=V/nD$, where J is the advance ratio, V is the flow velocity, n is the rotational velocity in Hz and D is the propeller diameter) were examined. For $J=1.91$; the propulsor produces little to no thrust and $J=1.43$; the propulsor produced sufficient thrust to overcome the drag produced by a body, stator and shroud.

The post-swirl normal (side) forces are based on computational predictions. As shown in FIG. 3, maximum normal forces for the pre-swirl maneuvering propulsor configuration are on the order of −0.3 for an open configuration −0.075 for a ducted configuration. The post-swirl maneuvering propulsor normal forces are significantly larger—even at 12 degree maximum stator pitch amplitude with maximum forces of −0.45 seen for the open configuration and −0.3 for the ducted configuration. These forces would be potentially larger for 15 degrees.

In addition, the normal forces increase with a decreased advance ratio corresponding to increased propeller thrust. The differences for the thrusting compared to the non-thrusting situations for the pre-swirl maneuvering propulsor are insignificant. Conversely, the ducted post-swirl maneuvering propulsor configuration produces sufficient side forces to enable vehicle control whereas the pre-swirl maneuvering propulsor configuration does not. As such, the post-swirl maneuvering propulsor calculations highlight a significant improvement to produce side forces sufficient for vehicle control.

Obviously many modifications and variations of the present invention may become apparent in light of the above teachings. For example, the design of the stator blades and the number of stator blades in the propulsor system described herein can be varied. Also the pitch of the stator blades can be varied in any number of ways, provided that the pitch variance produces the side forces and circumferentially varying flow described herein.

In light of the above, it is therefore understood that within the scope of the appended claims, the invention may be practiced otherwise than as specifically described.

What is claimed is:

1. A post-swirl propulsor system for maneuvering an underwater vehicle, said post-swirl propulsor system comprising:

a rotor positioned on an exterior circumference of the vehicle;

a plurality of stator blades positioned on the exterior circumference downstream of said rotor with each of said blades including a shaft extending into an interior of the vehicle, wherein a pitch angle of said stator blades can vary about the circumference of the vehicle;

a plurality of servo-motors interior to the vehicle with each servo-motor connected to each said stator blade by a movement of an actuator arm on the shaft of said stator blade;

a controller operationally connected to said servo-motors wherein said controller coordinates the actions of said servo-motors with a result of the pitch angle of each said stator blade being separately adjustable by actuation of said servo-motor by said controller wherein the movement of the actuator arm engages the shaft to rotate said stator blade for an adjusted pitch angle; and a protective shroud extending about said rotor;

wherein a thrust flow from said rotor is capable of combining with a circumferentially varying flow from said stator blades to produce a stator side force at varying angles to a longitudinal axis of the vehicle, the side force of said stators is inversely proportional to an advance ratio indicative of a forward distance generated thru a full rotation of said rotor where the advance ratio "J" is calculated from an equation $J=V/nD$ where "V" is a flow velocity, "n" is a rotational velocity in Hz and "D" is a diameter of said rotor.

* * * * *